United States Patent [19]

Clowers et al.

[11] 4,106,165

[45] Aug. 15, 1978

[54] RETRACTABLE CORD GUIDING AND LOCKING DEVICES

[75] Inventors: Earl R. Clowers, Anderson; John C. Davis, Greenwood, both of S.C.

[73] Assignee: The Singer Company, New York, N.Y.

[21] Appl. No.: 776,154

[22] Filed: Mar. 10, 1977

[51] Int. Cl.[2] ..... F16G 11/00; A47L 9/00

[52] U.S. Cl. ..... 24/134 R; 15/323; 188/65.2; 242/107.2

[58] Field of Search ..... 24/132 AA, 133, 134 R, 24/134 KA, 134 L, 132 R, 81 CC, 73 CC; 188/65.1, 65.2; 160/178 C; 242/107.2; 15/323; 182/5, 133; 114/199

[56] References Cited

U.S. PATENT DOCUMENTS

| | | | |
|---|---|---|---|
| 3,178,128 | 4/1965 | Meletti | 242/107.2 |
| 3,251,107 | 5/1966 | Scott | 24/134 R |
| 3,273,213 | 9/1966 | Zurkowski | 24/73 CC |
| 3,332,637 | 7/1967 | Price | 242/107.2 |
| 3,394,904 | 7/1968 | Meyerhoefer | 242/107.2 |

*Primary Examiner*—Kenneth J. Dorner

*Attorney, Agent, or Firm*—Alan Ruderman; Edward L. Bell; Robert E. Smith

[57] ABSTRACT

An upright vacuum cleaner having an elongated handle and a cord reel biased to retract the electrical cord has a cord guiding and locking device comprising a housing having two internal cavities open at both the top and bottom thereof and opening into each other. One of the cavities is adapted to clamp onto the handle above the cord reel, and the other cavity includes a locking member pivotably mounted in an opening formed in a wall thereof. The locking member has a pair of legs disposed angularly to one another, one leg has a through slot to allow the cord to pass therethrough when the plane of the slot is substantially perpendicular to the cord but is sized to frictionally grip the cord when the plane of the slot is not substantially perpendicular thereto. The other leg is accessible at the opening for depression by an operator and a stop member restrains the first leg and the slot to substantial perpendicularity when the cord is being extended from the reel and when the second leg is depressed. Frictional contact of the cord with the sides of the slot is effective to pivot the member.

1 Claim, 6 Drawing Figures

RETRACTABLE CORD GUIDING AND LOCKING DEVICES

BACKGROUND OF THE INVENTION

This invention relates to appliances having an electrical power cord and a rewind reel therefor, and more particularly to a cord guiding and locking device for gripping and selectively releasing the cord.

It is common for ambulatory household appliances such as upright suction cleaners to include self winding cord retracting reels. These retracting reels are spring biased to exert a continuous retracting force on the cord. Some of the cord reels are equipped with ratchet mechanisms to prevent cord retraction except when desired, but this construction adds to the cost of the unit and are subject to excessive wear and to malfunctions. In recognition of these defects a number of cord gripping and releasing devices have been proposed by the prior art. One such device, illustrated in Scott U.S. Pat. No. 3,251,107, uses a housing mounted on the upper portion of the handle and includes a spring biased locking lever having a serrated cam surface acting to functionally engage the cord against an anvil. The serrations however place more stress on the cord than is desirable. Other known devices use a wedging principle whereby the cord is wedged in a slot in a pivotable member when the plane of the slot is tilted. Examples of these latter devices are illustrated in Meletti U.S. Pat. No. 3,178,128; Price U.S. Pat. No. 3,332,637 and Meyerhoefer U.S. Pat. No. 3,394,904. The devices illustrated in these patents are however incorporated at the base of a canister vacuum cleaner near the reel and not on an upright handle remote from the reel. Another known device using the wedging principle comprises a pair of sheet metal members one of which is fixed to the handle of an upright cleaner and has a hole through which the cord passes, and another of which is pivotable and has a slot for wedging the cord until the pivotable member is tilted by squeezing together a pair of tabs, one on each member.

SUMMARY OF THE INVENTION

The present invention is an improvement over the known cord gripping and releasing devices and provides, in conjunction with a cord retracting reel on the handle of an electrically powered suction cleaner, a housing having first and second cavities, one conforming to the external shape of a handle for being secured thereto, and the second for receiving a first leg of a locking member having a pair of angularly disposed legs pivotably mounted in an opening formed in a wall of the second cavity. The first leg includes a through slot of a size to allow the electrical cord to pass when the plane of the slot is substantially perpendicular to the cord but to frictionally grip the cord when out of substantial perpendicularity therewith. The second leg of the locking member is accessible at the opening for depression to provide substantially perpendicularity and allow retraction of the cord. Moreover, the first and second cavities open into each other and the slot is open at one end so that the cord with the plug thereon can be inserted into the slot prior to assembling onto the handle.

It is therefore the primary object of the present invention to provide a cord gripping and releasing device for use with a cord retracting reel on the handle of an upright vacuum cleaner that is simple to operate and inexpensive to produce and assemble.

BRIEF DESCRIPTION OF THE DRAWINGS

Other objects and advantages of the invention will best be understood upon reading the following detailed description of the invention with the accompanying drawings, in which.

DETAILED DESCRIPTION OF THE PREFERRED EMBODIMENT

Figure 1:
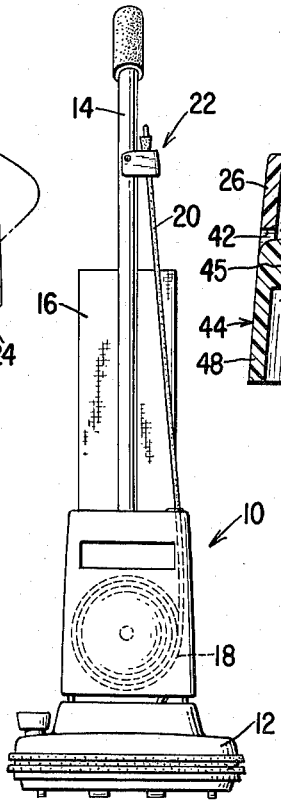
FIG. 1 is a front elevational view of a suction cleaner having a power cord retracting reel and incorporating a cord gripping and releasing device constructed in accordance with the present invention.
Figure 5:
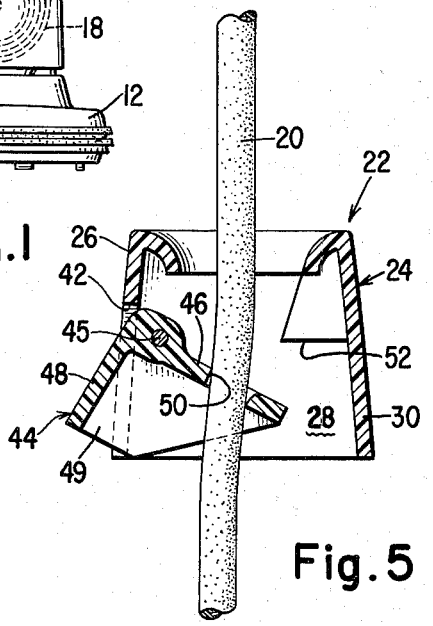
FIG. 5 is a view similar to FIG. 4 but with the locking member in the gripping position.

Referring to the drawings FIG. 1 illustrates an electrically powered suction cleaner 10 comprising a conventional suction producing chassis 12 having an elongated handle 14 pivotably secured thereto. A dirt retaining dust bag 16 communicating with the chassis suction means and a cord retracting reel 18 are mounted on the handle, the latter being supported at the base of the handle just above the chassis. The core reel is conventional and of the type known as an automatic reel since it is always biased to retract and wind the electrical power cord 20 which is connected thereto. A plug 21 is conventionally secured at the other end of the cord. In the use of the cleaner it is desirable that the cord be extended to a convenient length for mobility of the cleaner but not to such a length as to be cumbersome and hazardous. In order to keep the cord at the desired length and prevent retraction the present invention provides a cord gripping and releasing device 22 for selectively gripping and releasing the cord.

The device 22 of the present invention comprises a preferably plastic molded integral unitary hollow housing 24 having three side walls 26, 28 and 30 open at the top and bottom. The walls 26 and 30 are formed with respective internal oppositely facing arcuate walls 32 and 34 which extend toward each other but are spaced apart in the interior of the housing as at 36. The walls 32 and 34 also merge into the walls 26 and 30 but are spaced from each other as at 38 at the exterior of the housing oppositely to the wall 28. The walls 32 and 34 together with the walls 26 and 30 at the open side of the housing thus define an internal cavity which is substantially circular in cross section to correspond to the shape of the upper portion of the handle 14 and of a size to frictionally grip the handle. The side opening 38 is adapted to allow the housing, since it is plastic, to spread and receive the handle as the housing is forced thereon. A rivet 40 or the like may secure the housing to the upper part portion of a handle in a convenient location for the user.

Figure 2:
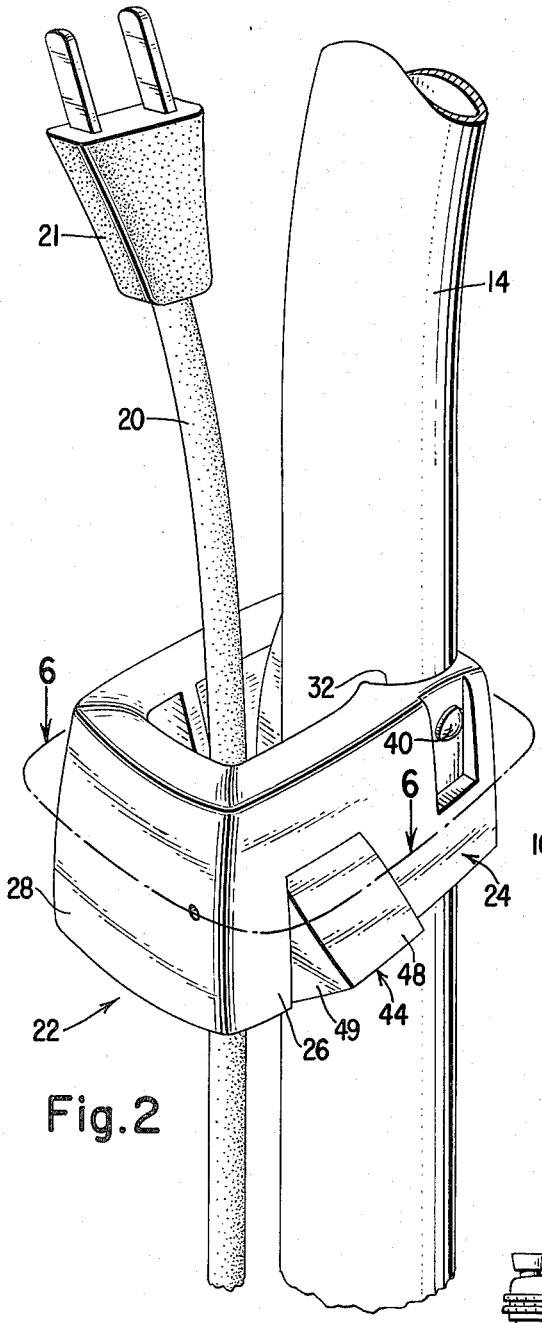
FIG. 2 is an enlarged fragmentary perspective view of a portion of the cleaner handle and the improved device illustrated in FIG. 1.
Figure 3:
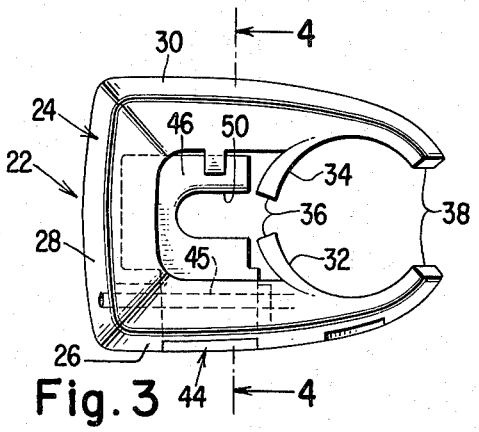
FIG. 3 is a top plan view of the device without the cord, removed from the cleaner and with the locking member in the cord retraction and extension position.
Figure 4:
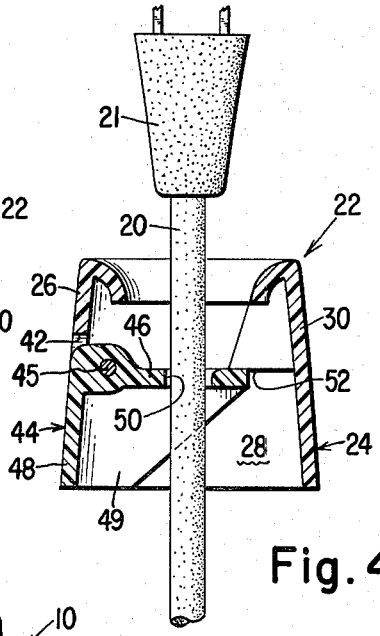
FIG. 4 is a cross sectional view taken substantially along line 4—4 of FIG. 3 but with the cord illustrated.
Figure 6:
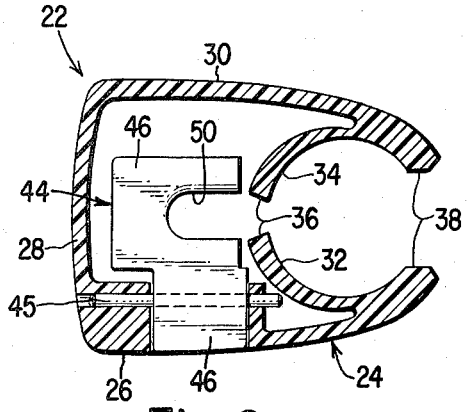
FIG. 6 is a cross sectional view taken through the device as illustrated in FIG. 2 with the cord removed and the locking member in the position illustrated in FIG. 3.

The interior of the housing between the walls 26, 28 and 30 and to the left of the walls 32 and 34 as viewed in FIGS. 3 and 6, define a second internal cavity. A cut-out 42 is formed in one of the walls, e.g. wall 26, and opens onto the interior of the second cavity for receiving a locking member 44 journalled on a pin 45 in the wall 26 bridging the opening 42.

The locking number 44 is effectively a bell crank lever having a first leg 46 and a second leg 48 disposed angularly, preferably approximately normal, to the first leg. A lateral web 49 may interconnect the legs 46 and 48 to provide increased strength. The angular relationship between the legs 46 and 48 is such that when the outer surface of the leg 48 is substantially coextensive with the outer surface of the wall 26, the plane of the leg 46 is substantially normal to the handle 14 and to the cord 20. Formed through the leg 46 is an elongated slot 50 of a width to allow the cord 20 to substantially freely pass therethrough when the cord is normal to the plane of the slot and the leg 46. However, the width of the slot is such that when the locking member is tilted so that the leg 46 and the plane of the slot 50 are out of substantial perpendicularity with the cord, the walls of the slot frictionally engage the cord to restrain its retraction into the reel. This may occur while the leg 48 is depressed so that the leg 46 is placed perpendicular to the cord, and when the cord is being extended out of the reel so that the frictional contact of the cord with the walls of the slot pivot the member 44. A stop member 52 is provided on the interior of the wall 30 to engage the outer extremity of the leg 46 at substantially the precise angular position of its upward travel to insure the position of substantial perpendicularity between the cord and the slot. Moreover, the slot opens at one end onto the space 36 that the cord 20 with the plug 21 attached may be inserted through the opening 38 and the first cavity and positioned in the slot 50 prior to assembling the housing onto the handle.

In operation, when the cleaner is to be used the operator pulls out the cord by pulling up on the plug. The member 44 pivots to the position where the slot is perpendicular to the cord and the cord is extracted. When released, the member 44 pivots downwardly by gravity and/or by the frictional force of the biased cord to remove the substantially perpendicular condition and the cord is locked in the slot by the frictional contact with the walls thereof. When the operator wants to retract the cord the leg 48 is depressed to provide substantial perpendicularity between the slot and the cord. This may result in fully retracting the cord until the plug engages the leg 46 or the walls about the top opening of the second cavity, or it may occur in an intermediate position determined by the release of the member 44.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

We claim:

1. A cord guiding and locking device for gripping and releasing a cord for an electrically actuated upright suction cleaner having an elongated tubular handle, a flexible electrical power cord with a plug, and a cord reel at the lower portion of the handle biased to retract the cord, said device comprising an integral hollow housing having side walls defining first and second internal cavities open at the top and bottom, said second cavity opening into said first cavity, the walls of a first of said cavities substantially conforming to the external contour of said handle for mounting thereon, means for securing said walls of said first cavity to the upper portion of said handle, means defining an opening in a wall of the second cavity, a locking member having first and second legs disposed angularly to one another, a first of said legs having a through slot therein of a size to allow the cord but not the plug to pass therethrough when the plane of the slot is substantially perpendicular thereto but to frictionally grip the cord when the plane of the slot is not substantially perpendicular thereto, said slot being opened at one end facing said first cavity, means for pivotably mounting said member in the opening with said first leg positioned in the second cavity and said second leg accessible at the opening for depression by an operator, said cord being positioned in the slot intermediate the reel and the plug, stop means within said second cavity for restraining the first leg and the slot to substantial perpendicularity when the cord is being extended and when the second leg is depressed, whereby frictional contact of the cord with the sides of the slot upon retraction of said cord is effective to pivot the member to tilt the plane of the slot away from perpendicularity with the cord to frictionally grip the cord and to perpendicularly align the slot and the cord to release the cord upon extension of the cord and upon depression of the second leg.

* * * * *